US006095529A

United States Patent [19]

Stahlecker

[11] Patent Number: 6,095,529

[45] Date of Patent: Aug. 1, 2000

[54] ARRANGEMENT FOR SEALING AN OPENING OF A ROTOR HOUSING

[75] Inventor: Gerd Stahlecker, Eislingen/Fils, Germany

[73] Assignee: Novibra GmbH, Suessen, Germany

[21] Appl. No.: 09/089,380

[22] Filed: Jun. 3, 1998

[30] Foreign Application Priority Data

Jul. 25, 1997 [DE] Germany ..... 197 32 096

[51] Int. Cl.[7] ..... F16J 15/56

[52] U.S. Cl. ..... 277/422; 277/411; 277/913; 57/414; 57/406

[58] Field of Search ..... 57/414, 406; 277/411, 277/412, 413, 422, 913

[56] References Cited

U.S. PATENT DOCUMENTS 2,964,339 12/1960 Macks ..... 277/422
3,009,717 11/1961 Laser ..... 277/422
3,160,416 12/1964 Ryffel ..... 277/422
3,595,002 7/1971 Koritysky ..... 57/406
3,685,839 8/1972 Frei ..... 277/422
4,383,406 5/1983 Oexler et al. ..... 57/406
5,299,813 4/1994 Mckenna ..... 277/422

*Primary Examiner*—Anthony Knight
*Assistant Examiner*—Vishal Patel
*Attorney, Agent, or Firm*—Evenson, McKeown, Edwards & Lenahan, P.L.L.C.

[57] ABSTRACT

An arrangement is provided for sealing the opening of a rotor housing under a low pressure, through which opening a shaft for a spinning rotor extends, which shaft is supported outside of the rotor housing. This arrangement comprises a sealing disk, which is supported floating relative to the opening and which is pressed against a bearing surface by means of a spring element. The floating sealing disk comprises a through bore hole having a narrow tolerance relative to the shaft. The spring element presses against the effect of the low pressure.

18 Claims, 1 Drawing Sheet

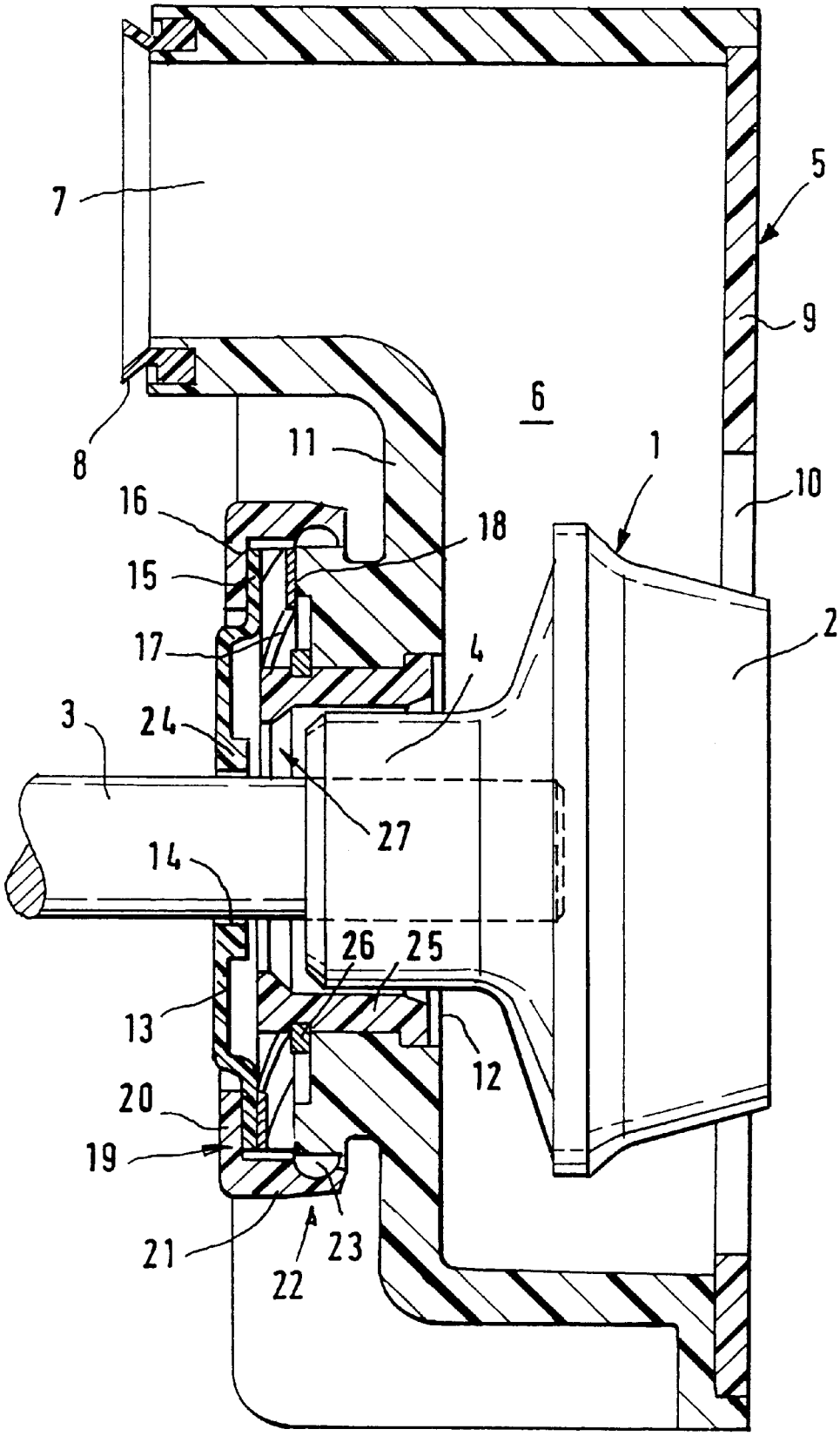
7
5
9
6
8
11
1
10
16
18
15
2
17
4
3
24
27
14
26
25
13
12
20
19
21
23
22

ARRANGEMENT FOR SEALING AN OPENING OF A ROTOR HOUSING

BACKGROUND AND SUMMARY OF THE INVENTION

This application claims the priority of German application 197 32 096.1, filed in Germany on Jul. 25, 1997, the disclosure of which is (are) expressly incorporated by reference herein.

The present invention relates to an arrangement for sealing an opening of a rotor housing under low pressure, and through which opening a shaft of a spinning rotor extends, said shaft being supported outside of the rotor housing, said arrangement comprising a sealing disk arranged floating relative to the opening and disposed on a bearing surface, which sealing disk comprises a through bore hole having a narrow tolerance in relation to the shaft, the diameter of the through bore hole being smaller than the diameter of the opening.

In the case of an arrangement of this type (U.S. Pat. No. 4,383,406), the size of the opening and the surface of the sealing ring affected by the low pressure must be structurally adapted to the installed low pressure in order to effect the desired action. In the case of such an arrangement, the design engineer has to work within a very narrow framework. The sealing ring alters its position when no effective low pressure is present, for example when the lid which closes the rotor housing is opened or when the machine is stopped. According to the prevailing conditions in the spinning mill, this may often be the case. When the low pressure is again generated, the sealing disk has to be readjusted, whereby it comes into sliding contact with the shaft of the spanning rotor.

It is an object of the present invention to create an arrangement of the above mentioned type comprising a floating sealing disk, which is independent of the vacuum required for spinning in the spinning unit.

This object has been achieved in accordance with the present invention in that the sealing disk is pressed, counteracting the effect of the low pressure, against the bearing surface by means of at least one spring element.

By means of the application of the spring element, there is complete independence from the installed low pressure. As the effect of the spring element is directed against the action of the low pressure, a bearing surface can be easily structurally realized which keeps the sealing disk in its position, when for example the machine is stopped and no effective low pressure is present, or when the spinning rotor—for example when a known supporting disk bearing is used—is taken out of the open end spinning aggregate through the opening towards the service side.

The spring element is advantageously designed as a type of disk spring, which is supported on the one side on a supporting surface of the rotor housing and on the other side on the bearing surface. When the disk spring hereby takes the form of a so-called zigzag spring, the resilient ring is disposed alternately on the supporting surface and on the bearing surface, as seen from a circumferential direction.

Assembly can be carried out in a particularly simple way when the bearing surface is arranged to a ring-like component, which preferably can be clipped onto a holding notch of the rotor housing.

The sealing effect can be improved when the sealing disk is disposed adjacent to a collar pressed onto the shaft and when the sealing disk and the collar form a labyrinth seal.

The pressed-on collar is present in any case in known spinning rotors in which a rotor cup is pressed onto the shaft. Thus a labyrinth-type, additional deflection arises, which hinders the entry of inleaked air into the rotor housing.

In order to effect a reaction against the unavoidable wear of the sealing disk at the through bore hole, the sealing disk is provided at the through bore hole for this purpose with a thicker wall.

These and further objects, features and advantages of the present invention will become more readily apparent from the following detailed description thereof when taken in conjunction with the accompanying drawing.

BRIEF DESCRIPTION OF THE DRAWINGS

The single drawing FIGURE is a sectional view of an open end rotor spinning arrangement constructed in accordance with a preferred embodiment of the present invention.

DETAILED DESCRIPTION OF THE DRAWINGS

The single drawing FIGURE shows a cross section through an open end spinning arrangement in the area of a spinning rotor assembly 1. This rotor assembly 1 comprises a rotor cup 2 as well as a shaft 3. The rotor cup 2 is pressed onto the shaft 3 in a known way by means of a collar 4.

During operation, the rotor cup 2 rotates in a low pressure chamber 6, which is formed by a rotor housing 5. The low pressure chamber 6 is connected, by means of a connection 7, through an intermediary sealing ring 8, to a low pressure supply (not shown).

The front side 9 of the rotor housing 5 comprises a service opening 10, which is closed during operation by means of a housing cover (not shown), so that no inleaked air enters the low pressure chamber 6. The back wall 11 of the rotor housing 5 comprises an opening 12, through which the shaft 3 extends. The shaft 3 is supported outside of the rotor housing 5 in a way not shown and is driven to rotate.

In order to prevent inleaked air entering the low pressure chamber 6 through the opening 12, an arrangement for sealing the opening 12 is provided. This arrangement comprises a sealing disk 13, which is provided with a through bore hole 14 for the shaft 3. The diameter of the through bore hole 14 is smaller than the diameter of the opening 12 and has a narrow tolerance relative to the shaft 3. The ring gap between the through bore hole 14 and the shaft 3 amounts to only a few tenths of a millimeter.

The sealing disk 13 is arranged floating relative to the opening 12, so that it can center itself relative to the shaft 3 during operation of the spinning rotor 1. The sealing disk 13 comprises a radial flange 15, which is arranged at an also radially aligned bearing surface 16. The bearing surface 16 faces away from the low pressure side and is made of low friction plastic, as is the sealing disk 13, so that the desired floating movement is permitted to take place during operation without any problems.

A spring element 17 serves to press the sealing disk 13 onto the bearing surface 16, which spring element 17 acts in the opposite direction to the effect of the low pressure. The spring element 17 takes the form of a disk spring in the form of a zigzag spring, which—in circumferential direction—is supported alternately on a supporting surface 18 of the rotor housing 5 and on the bearing surface 16 by way of the sealing disk 13.

The bearing surface 16 is a part of a ring-like component 19, which comprises a radial flange 20 containing the bearing surface 16 as well as a flexibly designed circumferential ring 21. With the aid of this ring-like component 19 a clip connection 22 can be created with which the component 19 can be clipped on at least one holding notch 23 of the rotor housing 5.

The sealing disk 13 has a thicker wall 24 in the area of the through bore hole 14, which counteracts the wear caused by the rotating shaft 3.

A plastic tube 25 is inserted into the opening 12 from the service side, which plastic tube is secured by means of a metal locking ring 26 to the rotor housing 5. The plastic tube 25 surrounds the collar 4 and forms together with the through bore hole 14 an additional labyrinth seal 27, which improves the sealing effect.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for sealing an opening of a rotor housing under low pressure, through which opening a shaft of a spinning rotor extends, said shaft being supported outside of the rotor housing, said arrangement comprising a sealing disk floatingly arranged relative to the opening and disposed on a bearing surface, said sealing disk comprising a through bore hole having a narrow tolerance relative to the shaft, the diameter of the through bore hole being smaller than the diameter of the opening, wherein the sealing disk is pressed against the bearing surface by means of at least one spring element acting against the effect of the low pressure.

2. An arrangement according to claim 1, wherein the spring element takes the form of a disk spring, which is supported on a supporting surface of the rotor housing as well as on the bearing surface by way of the sealing disk.

3. An arrangement according to claim 2, wherein the disk spring is designed as a zigzag spring.

4. An arrangement according to claim 1, wherein the bearing surface is arranged on a ring-like component, which can be clipped on to at least one holding notch of the rotor housing.

5. An arrangement according to claim 2, wherein the bearing surface is arranged on a ring-like component, which can be clipped on to at least one holding notch of the rotor housing.

6. An arrangement according to claim 3, wherein the bearing surface is arranged on a ring-like component, which can be clipped on to at least one holding notch of the rotor housing.

7. An arrangement according to claim 1, wherein the sealing disk is adjacent to a collar pressed onto the shaft which both together form a labyrinth seal.

8. An arrangement according to claim 2, wherein the sealing disk is adjacent to a collar pressed onto the shaft which both together form a labyrinth seal.

9. An arrangement according to claim 3, wherein the sealing disk is adjacent to a collar pressed onto the shaft which both together form a labyrinth seal.

10. An arrangement according to claim 4, wherein the sealing disk is adjacent to a collar pressed onto the shaft which both together form a labyrinth seal.

11. An arrangement according to claim 6, wherein the sealing disk is adjacent to a collar pressed onto the shaft which both together form a labyrinth seal.

12. An arrangement according to claim 1, wherein the sealing disk has a thicker wall at the through bore hole than at radially outer portions.

13. An arrangement according to claim 2, wherein the sealing disk has a thicker wall at the through bore hole than at radially outer portions.

14. An arrangement according to claim 3, wherein the sealing disk has a thicker wall at the through bore hole than at radially outer portions.

15. An arrangement according to claim 4, wherein the sealing disk has a thicker wall at the through bore hole than at radially outer portions.

16. An open-end rotor spinning assembly comprising:

a rotor shaft supporting a rotor cup at one end of the shaft, a low pressure rotor housing surrounding the rotor cup and having a shaft opening accommodating the rotor shaft, a radially floating sealing disk having a through bore hole for the rotor shaft, said through bore hole being smaller than the shaft opening, and at least one spring element axially pressing the sealing disc against a bearing surface against the effect of low pressure in the housing.

17. An assembly according to claim 16, wherein the spring element takes the form of a disk spring, which is supported on a supporting surface of the rotor housing as well as on the bearing surface by way of the sealing disk.

18. An assembly according to claim 17, wherein the disk spring is designed as a zigzag spring.

* * * * *